US007997210B2

(12) United States Patent
Clark

(10) Patent No.: US 7,997,210 B2
(45) Date of Patent: Aug. 16, 2011

(54) RAIL CAR DOOR CLOSER SYSTEM WITH WING CLOSERS

(76) Inventor: Melvin Gary Clark, Pipe Creek, TX (US)

( * ) Notice: Subject to any disclaimer, the term of this patent is extended or adjusted under 35 U.S.C. 154(b) by 0 days.

(21) Appl. No.: 12/701,460

(22) Filed: Feb. 5, 2010

(65) Prior Publication Data

US 2010/0258030 A1 Oct. 14, 2010

Related U.S. Application Data

(60) Provisional application No. 61/150,110, filed on Feb. 5, 2009.

(51) Int. Cl.
*B61D 5/00* (2006.01)

(52) U.S. Cl. ..... 105/241.2; 105/240

(58) Field of Classification Search ..... 105/239, 105/241.1, 241.2, 253, 280, 286, 288, 307
See application file for complete search history.

(56) References Cited

U.S. PATENT DOCUMENTS

| | | | | | |
|---|---|---|---|---|---|
| 4,235,169 | A * | 11/1980 | Peterson | 105/251 |
| 4,329,106 | A * | 5/1982 | Adler | 414/388 |
| 4,829,908 | A * | 5/1989 | Hallam | 105/240 |
| 5,249,531 | A * | 10/1993 | Taylor | 105/290 |
| 5,299,508 | A * | 4/1994 | Connelly | 105/241.2 |
| 5,302,072 | A * | 4/1994 | Stauffer et al. | 414/387 |
| 5,359,942 | A * | 11/1994 | Ward | 105/240 |
| 5,419,262 | A * | 5/1995 | Turpin, Sr. | 105/241.2 |
| 5,601,032 | A * | 2/1997 | Kosch | 105/304 |
| 5,657,700 | A * | 8/1997 | Bounds | 105/311.1 |
| 6,431,084 | B1 * | 8/2002 | Gaydos | 105/247 |
| 6,886,473 | B2 * | 5/2005 | Marchiori et al. | 105/241.2 |
| 7,178,464 | B2 * | 2/2007 | Clark | 105/241.2 |
| 7,559,283 | B2 * | 7/2009 | Clark | 105/241.2 |
| 2005/0120905 | A1 * | 6/2005 | Clark | 105/241.2 |
| 2010/0005999 | A1 * | 1/2010 | Register et al. | 105/241.2 |

* cited by examiner

*Primary Examiner* — S. Joseph Morano
*Assistant Examiner* — Jason C Smith
(74) *Attorney, Agent, or Firm* — Kammer Browning PLLC

(57) ABSTRACT

An improved rail car door closer system is provided wherein the movement of a number of appropriately positioned closer wing plates into contact with a number of open rail car hopper doors, is accomplished with hydraulic cylinders and motors. The system incorporates components that direct both the rotation of the wing closers (around a cylindrical frame so as to position the wing closers in and out of position for door closure), and the translation of the wing closers (along the longitudinal cylindrical frame so as to effect the actual closing of the hopper doors). The system is arranged to close more than one door at a time and in the preferred embodiment includes three simultaneously operated door closer wing structures. The heavy duty cylindrical frame incorporates a number of cylindrical outer segments sized to fit around and on the inner cylindrical frame. The segments are directed to rotate and translate on the inner cylindrical frame. Heavy duty coil springs are used to link the movable outer segments, one to the other, and to serve as force dampening structures during operation of the system. A double acting hydraulic cylinder is arranged to direct the translational movement of the closer wings while a low speed hydraulic motor is used to direct their rotational movement. The system may operate manually through the use of a number of hydraulic valves or may be operated semi-automatically through a programmed sequence of closer wing movements.

11 Claims, 3 Drawing Sheets

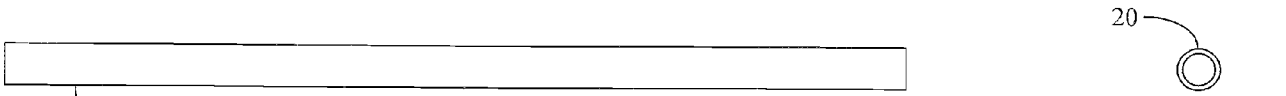
Fig. 2A
Fig. 2B
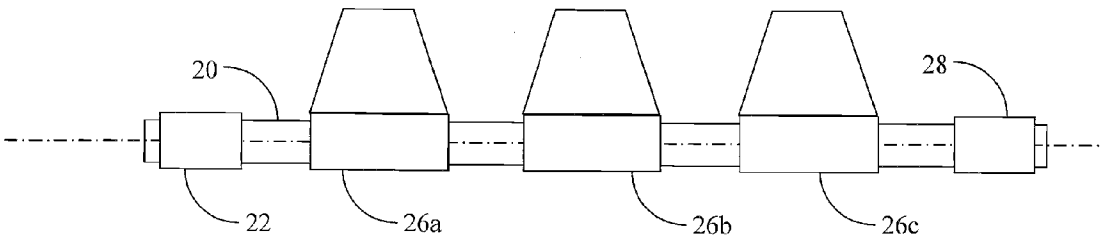
Fig. 3A
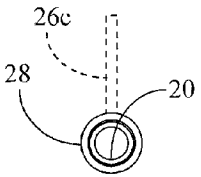
Fig. 3B
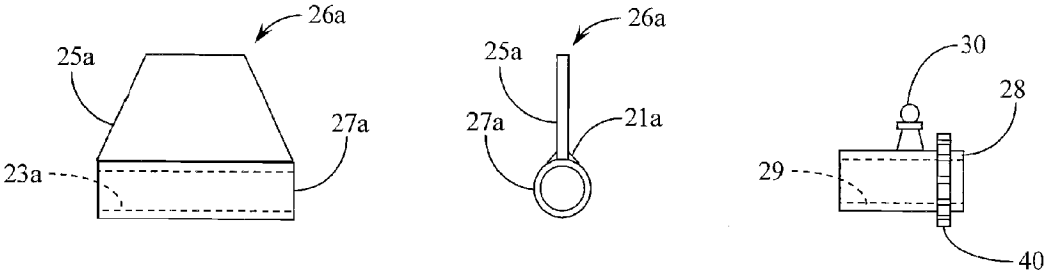
Fig. 4A
Fig. 4B
Fig. 5A
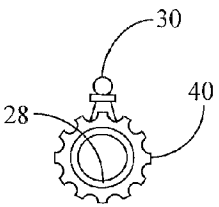
Fig. 5B

RAIL CAR DOOR CLOSER SYSTEM WITH WING CLOSERS

CROSS REFERENCES TO RELATED APPLICATIONS

This application claims the benefit under Title 35 United States Code §119(e) of U.S. Provisional Application 61/150,110 filed Feb. 5, 2009 the full disclosure of which is incorporated herein by reference.

BACKGROUND OF THE INVENTION

1. Field of the Invention

The present invention pertains generally to rail car door closures. More specifically, the present invention relates to a system of rail car door closing wing assemblies that enable the simultaneous closing of multiple rail car hopper doors.

2. Description of the Related Art

The present invention relates to an apparatus for the closure of rail car doors, specifically, the discharge doors of a coal or aggregate hopper car. These doors are extremely heavy and when open, extend vertically downward on hinges from the car frame. When closed, the doors are latched to the car frame and thus secured to prevent opening. When an aggregate or coal car reaches a delivery site, the doors are opened and the contents of the car emptied into receiving areas below the tracks. The car doors must be closed, of course, prior to departure from the site and reloading. The doors are extremely difficult to close manually and such an undertaking is very dangerous to the workers involved in such an operation. Severe injuries may result if a car door fails to latch, swings back open, and strikes a worker.

Various efforts have been made in the past to provide a mechanized system to close these rail car hopper doors. The present invention makes significant improvements to the type of rail car door closer disclosed in U.S. Pat. No. 6,886,473, Issued; May 3, 2005, to Marchiori and Clark; Entitled: Rail Car Door Closer, the disclosure of which is incorporated herein in its entirety by reference.

The above effort to provide a rail car door closer suffers from excessive complexity and/or difficulty of use. Although the wing shaped closer arm of the above cited disclosure provides an effective structure for directing the closure of pairs of rail car hopper doors, the mechanisms for manipulating the closer is complex and prone to misalignment. It would be desirable to have a rail car door closer that is relatively inexpensive, operationally simple, and safe to use.

SUMMARY OF THE INVENTION

The present invention therefore provides an improved rail car door closer system wherein the lifting of a plurality of appropriately positioned door closer wings is accomplished with hydraulic cylinders and motors. The system incorporates components that direct both the rotation of the wing closers around a cylindrical frame so as to move them in and out of position for door closure, and a translational movement along the longitudinal cylindrical frame so as to effect the actual closing of the hopper doors. The system is arranged to handle more than one door at a time and in the preferred embodiment includes three door closer wing structures. The heavy duty cylindrical frame incorporates a number of concentric cylindrical outer sections that are directed to rotate and translate on the inner cylindrical frame. The heavy duty cylindrical frame incorporates a number of cylindrical outer sections sized to fit around and on the inner cylindrical frame and that are directed to rotate and translate on the inner cylindrical frame. Heavy duty coil springs are used to link the movable outer sections one to the other and serve as force dampening structures during operation. A double acting hydraulic cylinder is arranged to direct the translational movement of the closer wings while a low speed hydraulic motor is used to direct the rotational movement of the closer wing sections. The system may operate manually through the manual operation of a number of hydraulic valves or may be operated semi-automatically through a programmed sequence of closer wing movements.

BRIEF DESCRIPTION OF THE DRAWINGS

A better understanding of the rail car door closer improvements of the present invention may be had by reference to the drawing figures wherein:

FIGS. 2A & 2B provide detailed side and end views of the structure of the inner cylindrical frame component of the system of the present invention.

FIGS. 3A & 3B provide detailed side and end views of the structure of the outer cylindrical section moving components of the system of the present invention.

FIGS. 4A & 4B provide detailed side and end views of the structure of a door closer plate section component of the present invention.

FIGS. 5A & 5B provide detailed side and end views of the structure of the control tube end section component of the present invention.

DETAILED DESCRIPTION OF THE PREFERRED EMBODIMENTS

Figure 1:
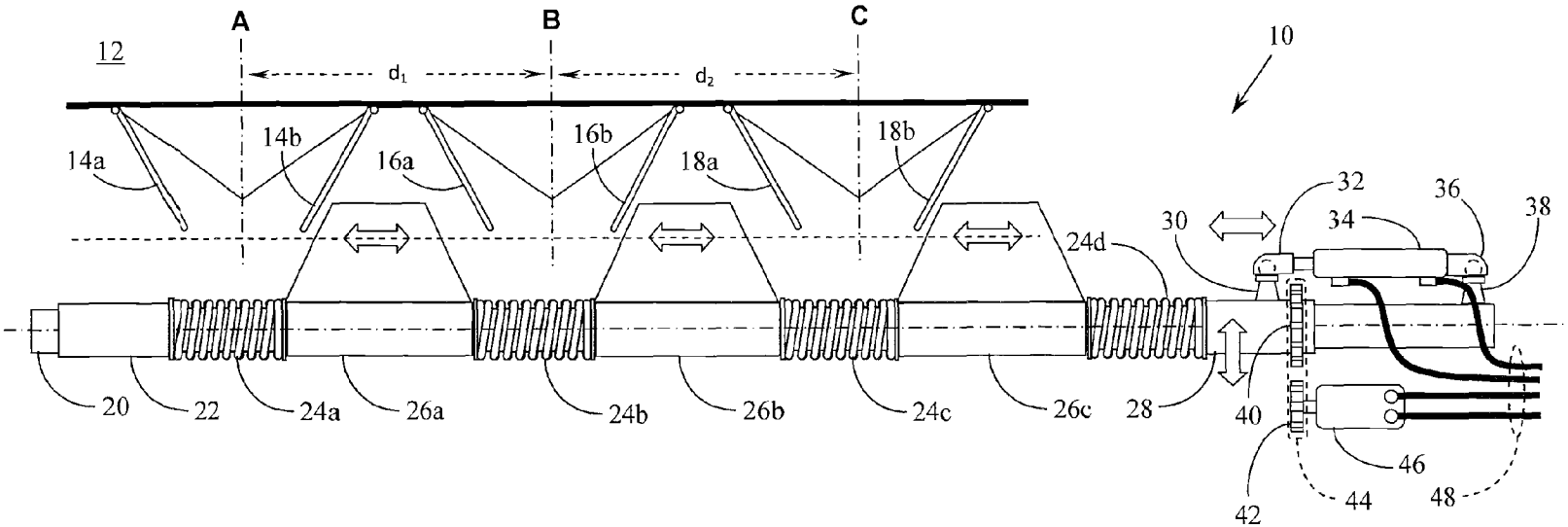
FIG. 1 is a schematic overview of the system of the rail car door closer components of the present invention as assembled and position adjacent a set of rail car hopper doors.

Reference is made first to FIG. 1 for an overview description of the complete system of the present invention. FIG. 1 is a partially schematic (not to scale) side view of the system of the present invention positioned for operation in conjunction with a typical rail car with three sets of bottom opening hopper door closures. In the configuration shown in FIG. 1 the system is positioned and aligned to initiate the closure of a first side set of three doors, one for each of the three cargo hoppers. Movement of the system in the process of closing the doors, as well as the corresponding second set of three doors, is described in more detail below.

Rail car door closure system 10 is comprised of a string of linked components positioned in association with a section of track onto which may be moved a typical three hopper rail car 12. Those skilled in the art will recognize that variations on the structure of the rail car 12 and the number of hopper doors associated with the rail car may be anticipated. Modifications to the system of the present invention would likewise follow from such variations and the standard structures of such rail car aggregate cargo haulers. In FIG. 1, rail car 12 is shown to have three sets of hopper doors; a first set of hopper doors 14*a* and 14*b*, a second set of hopper doors 16*a* and 16*b*, and a third set of hopper doors 18*a* and 18*b*. This is the configuration of a typical rail car designed to transport aggregate, coal, and other heavy particulate materials. In practice, the rail car is moved to a particular position on the track and all of the hopper doors are opened for the release of the aggregate cargo. The system of the present invention is then called into play, either at the location of cargo release or immediately adjacent thereto, for the purpose of closing the hopper doors after the rail car has been emptied of its cargo.

The primary fixed component of the rail car door closer system 10 of the present invention is inner tubular main frame 20 which is a cylindrical frame (pipe) that extends the length of the system, onto which are positioned, rotated, and slid, the various moving components of the system. At one end of the system 10, opposite from the control mechanisms described in more detail below, is a first outer tube end segment 22. Although this cylindrical end segment 22 may rotate on tubular main frame 20 it is intended to act as an end stop for lateral translational movement (sliding) axially along tubular main frame 20. This end stop function can be achieved through the use of a large stop plate or pin positioned through tubular main frame 20 to the outside edge of outer tube end segment 22.

Interspersed between the active sections of the system are a number of coil springs 24*a*-24*d*. In each instance these coil springs 24*a*-24*d* may rotate around tubular main frame 20, but are laterally fixed in association with the various end segments 22 and 28 as well as with the various door closer plate segments 26*a*-26*c*. The series of components thus linked by welding or other means of permanent attachment, one to the next, comprises outer tube end segment 22 to which is attached coil spring 24*a* followed by door closer plate segment 26*a* followed by a further coil spring 24*b*. Coil spring 24*b* is fixed to door closer plate segment 26*b* which is in turn fixed to a further coil spring 24*c*. Coil spring 24*c* is in turn fixed to door closer plate segment 26*c* which is followed by permanent attachment to a final coil spring 24*d*. Coil spring 24*d* is fixed to control tube end segment 28. Each of these linked components is capable of rotating on tubular main frame 20 as a function described in more detail below and further to move longitudinally along the axis of tubular main frame 20 in some cases against the residual tension in coil springs 24*a*-24*d*. Coil springs 24*a*-24*d* likewise will provide some rotational dampening as well as the aforementioned translational motion dampening.

The placement, orientation, and positioning of these various components linked along tubular main frame 20 is such as to appropriately place the door closer plate segments 26*a*-26*c* immediately below the rail car hopper doors as shown. It is in the process of rotating these components (radially around tubular main frame 20) and longitudinally sliding or translating these components along the axis of tubular main frame 20, that allows the system to carry out the progressive closure of each of the various hopper doors on rail car 12.

Initially, the door closer plate segments 26*a*-26*c* are in a rotated position 90° to the position shown in FIG. 1. This rotated position (wherein the plates would extend out from the drawing page towards the viewer) would position the plates in an orientation generally parallel to the ground and is suitable for movement of the rail car into position for release of the hopper doors. When the rail car hopper doors are ready to be closed (and the rail car is appropriately positioned over the door closer system), the system of the present invention rotates door closer plate segments 26*a*-26*c* from their flat orientation 90° to the elevated position perpendicular to the ground, as shown in FIG. 1.

After such rotational motion, the system directs the longitudinal or translational movement of the linked assembly along the long axis of tubular main frame 20. It can be seen in FIG. 1 how this lateral motion along the axis of tubular main frame 20 will direct the concurrent closure of a first set of three of the hopper doors (all of which close in the same direction) on rail car 12. At the position shown in FIG. 1 the system is in the process of directing the closure of hopper doors 14*b*, 16*b*, and 18*b*. The structure of the hopper doors is such that directing their closure results in an automatic latching of the door such that no manual interaction is required. After this first set of three hopper doors has been closed, the system again rotates as much as 90° (out of the page towards the viewer in the drawing figure) and is then laterally (translationally) moved to a point past the remaining open hopper doors 14*a*, 16*a*, and 18*a*, where the system is then again rotated 90° to raise the door closer plate segments 26*a*-26*c* to a position where they will encounter these remaining open hopper doors 14*a*, 16*a* and 18*a*. In a manner similar to that described above, the system then closes and automatically latches the doors to the rail car hoppers. Once the linked door closer plate segments 26*a*-26*c* have thus closed each of the rail car doors, they may again be rotated 90° (out of the page) to remove them from a path obstructing the subsequent motion of the rail car away from the door closer or unloading station.

Figure 6:
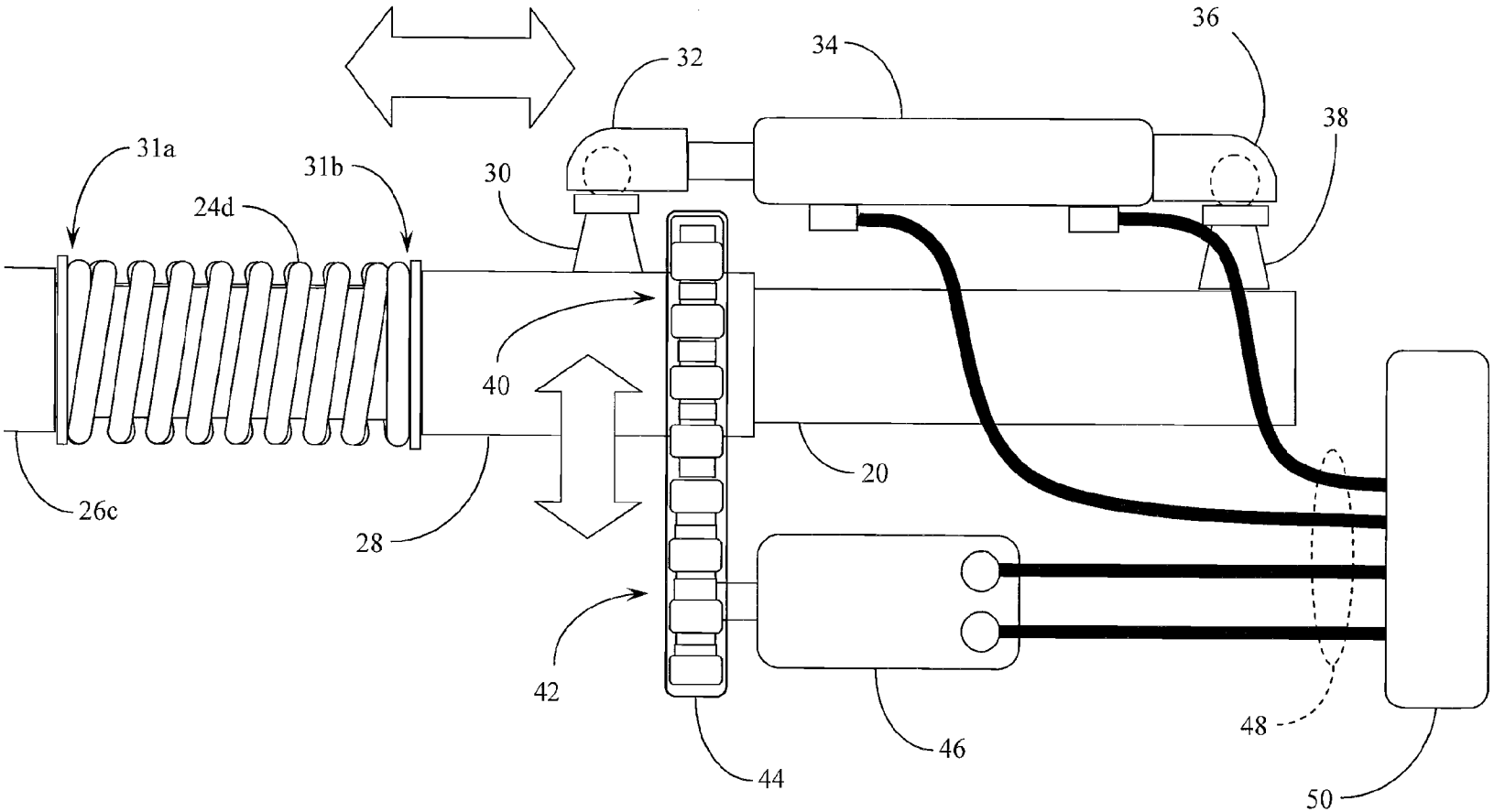
FIG. 6 is a detailed view of the motion control end of the system of the present invention showing the hydraulic cylinder and the hydraulic pump components.

With the above described motions in mind, the control system of the present invention as shown to the right side of FIG. 1 is now described in more detail, here and in conjunction with FIG. 6. Both the rotational motion of the linked components and the longitudinal translational motion of these components are controlled and established by way of control tube end segment 28. This component, described in more detail below, essentially comprises a cylindrical section that rotates and translates on tubular main frame 20 under the control of a hydraulic cylinder 34 (for translational motion) and a low speed hydraulic motor 46 (for rotational motion). Hydraulic cylinder 34 is a double acting hydraulic cylinder operable through a pair of hydraulic hoses 48, which is fixed at a first end through a ball joint connection comprising fixed end ball joint female component 36 and fixed end ball joint male component 38. Fixed end ball joint male component 38 may in the preferred embodiment be rigidly fixed onto tubular main frame 20. In this manner the expansion and contraction of hydraulic cylinder 34 directs the translational motion of the system as described above. A further key feature of the system is the ability of the extended end of the hydraulic cylinder 34 to move slightly side to side (in and out of the page in FIG. 1) as control tube end segment 28 rotates on tubular main frame 20.

On the opposite end of hydraulic cylinder 34 is the piston shaft that translates in and out of the cylinder to direct the longitudinal or translational motion of the system. A second ball joint comprises floating end ball joint male component 30 and floating end ball joint female component 32. These two ball joints, one fixed and one floating, allow for the necessary movement of hydraulic cylinder 34 during the translational and rotational motions of the components of the system. It is the hydraulic cylinder 34 that directs the lateral movement of door closer plate segments 26*a*-26*c* which thereby accomplish the actual closing of the rail car hopper doors.

The rotational motion described above, which primarily achieves the function of moving the door closer plate segment wings in and out of position for the door closing action, is accomplished by way of follower chain sprocket 40 combined with motor drive chain sprocket 42 and a loop section of drive chain 44 shown in dashed outline form in FIG. 1. This drive sprocket and follower sprocket arrangement is rotationally powered by low speed hydraulic motor 46 which is a bi-directional motor that will rotate motor drive chain sprocket 42 thereby moving drive chain 44 and rotating follower chain sprocket 40 which is fixed (welded preferably) to the circumference or outer surface of control tube end segment 28.

It is recognized that standard hydraulic control systems may be utilized to direct the operation of both hydraulic cylinder 34 and low speed hydraulic motor 46. The coordinated rotation and translation of the components of the system may therefore be easily programmed and controlled, either automatically or through a series of coordinated manual actions with standard hydraulic control valves. In either case, the process described above whereby the door closer plate segments 26*a*-26*c* are alternately raised and lowered into position by rotational movement directed by hydraulic motor 46, in conjunction with the translational motion imparted to the linked system by way of hydraulic cylinder 34, achieve the full sequence of door closure steps and actions.

Reference is now made to FIGS. 2A through 5B for a more detailed description of each of the primary structural components of the system of the present invention. FIGS. 2A and 2B provide a side view and an end view respectively of a typical interior tubular main frame 20 appropriate for forming the base frame fixed component for the system of the present invention. FIGS. 3A and 3B show in simple schematic detail the various moving components as they would be positioned concentrically onto the cylindrical structure of tubular main frame 20. These components are, as described above, outer tube end section 22, door closer plate segments 26*a*-26*c*, and control tube end segment 28. The coil springs and the various ancillary components associated with control tube end segment 28 are not shown in this view for clarity. The end view shown in FIG. 3B of this partial assembly of components show the manner in which the rotating and sliding components concentrically surround the cylindrical tubular main frame 20.

FIGS. 4A and 4B disclose in greater detail the structure of each of the door closer plate segments 26*a*-26*c*. These components, an end view of which is shown in FIG. 4B, generally comprise a cylindrical segment 27*a* having an inside diameter 23*a* slightly greater than the outside diameter of tubular main frame 20. This allows the components to slide and rotate on tubular main frame 20 as required with the function of the system. Each of door closer plate segments 26*a*-26*c* will generally include a wing shaped plate 25*a* that is welded 21*a* to the cylindrical section 27*a* of the component radially out from an axial center point for the cylindrical component. In this manner, rotation of the entire component around tubular main frame 20 will achieve the movement of the plate 25*a* through the greater arc of motion directing the wing shaped plate through a 90° swing, into and out of potential contact with the rail car hopper doors.

FIGS. 5A and 5B provide greater detail on the structure of control tube end segment 28 showing the manner in which follower chain sprocket 40 is fixed into position (welded) onto the cylindrical section of the end segment. Also positioned radially out from the cylindrical end section is floating end ball joint male component 30. These two attachment points provide the necessary linkage to the control components of the system to impart the rotational and translational motions to the system as described above. Here also, the inside diameter 29 of control tube end segment 28 is such as to be incrementally larger than the outside diameter of tubular main frame 20.

Reference is finally made to FIG. 6 for a detailed description of the motion directing components of the system of the present invention and the method by which closure of the rail car hopper doors is achieved. As indicated above, both the rotational motion of the linked components and the longitudinal translational motion of these components are controlled and established by way of control tube end segment 28. This component, shown to have both rotational motion (vertical arrow) and lateral motion (horizontal arrow) comprises a cylindrical section that fits on tubular main frame 20 and operates under the control of hydraulic cylinder 34 (for translational motion) and hydraulic motor 46 (for rotational motion).

Hydraulic cylinder 34 is fixed at a first end with a ball joint connection comprising fixed end ball joint female component 36 and fixed end ball joint male component 38. Fixed end ball joint male component 38 is preferably mounted or welded onto tubular main frame 20. In this manner the expansion and contraction of hydraulic cylinder 34 directs the translational motion of the linked components of the system as described above.

On the opposite end of hydraulic cylinder 34 is the piston shaft that moves (under the influence of the pressurized hydraulics) in and out of the cylinder to direct the translational motion of the system. A second ball joint makes up the "floating" end ball joint and comprises male component 30 and female component 32. These two ball joints, one fixed and one floating, allow for the necessary movement of hydraulic cylinder 34 during both the translational motion (which itself directs) and the rotational motion of the components of the system (directed by the hydraulic motor). As indicated above, it is the hydraulic cylinder 34 that directs the lateral movement of door closer plate segments 26*a*-26*c* which thereby accomplishes the actual closing of the rail car hopper doors.

The rotational motion described above is accomplished by way of the combination of linked follower chain sprocket 40 and motor drive chain sprocket 42 connected with drive chain 44 shown surrounding the sprockets in FIG. 6. The drive sprocket and follower sprocket arrangement is rotationally powered by low speed hydraulic motor 46 which rotates motor drive chain sprocket 42 thereby moving drive chain 44 and rotating follower chain sprocket 40. Follower chain sprocket 40 is fixed (welded) to control tube end segment 28.

The system has therefore been disclosed herein by reference to a preferred embodiment and a number of alternate embodiments. It is anticipated that those skilled in the art will recognize further modifications and extensions of the present invention described above that fall within the spirit and scope of the invention. There may, for example, be alternate methods for directing the rotational and translational motions required by the system. The hydraulic motor could be replaced by a second hydraulic cylinder that directs the movement of a lever arm fixed to the control tube end segment, thereby imparting a rotational motion to the cylindrical segment (and the balance of the linked segments as described). Likewise, the hydraulic systems described could be replaced by pneumatic systems or electric drive systems to achieve the motions described, although hydraulics tend to deliver greater work to the heavy duty components of the system thus constructed. While it is anticipated that most of the structural components of the system would best be made from steel and/or iron stock, other materials may exhibit the necessary structural strength to accomplish the forces required by the system functionality.

I claim:

1. A system for simultaneously closing multiple hopper doors on a rail car positioned on a track, the system comprising:

a tubular frame guide member fixed in position with respect to the rail car and extending generally parallel to the track adjacent the rail car and the hopper doors;

a plurality of closer arm wing segments movably positioned on the tubular frame guide member, the wing segments rotationally and translationally operable around and along the tubular frame guide member to make contact with and close the hopper doors;

a linkage assembly connecting the closer arm wing segments together and operable to transfer rotational and translational movement between the closer arm wing segments in concert, the linkage assembly comprising a plurality of coil springs movably positioned on the tubular frame guide member and extending between and fixed to the closer arm wing segments;

a motion control segment movably positioned on the tubular frame guide member and connected to the linkage assembly and thereby to the plurality of closer arm wing segments and operable to direct the rotational and translational movement of the linkage assembly and the plurality of closer arm wing segments around and along the tubular frame guide member;

a linear actuator connected to the motion control segment, linearly operable to direct the translational movement of the motion control segment and thereby of the linkage assembly and the plurality of closer arm wing segments; and a rotational actuator connected to the motion control segment, rotationally operable to direct the rotational movement of the motion control segment and thereby of the linkage assembly and the plurality of closer arm wing segments.

2. The system of claim 1 wherein the tubular frame guide member has an external diameter and the plurality of closer arm wing segments each comprise:

a tubular cylindrical section having an internal diameter incrementally greater than the external diameter of the tubular frame guide member, the tubular cylindrical section movably positioned around the tubular frame guide member; and a generally flat wing section attached to and extending radially out from the tubular cylindrical section, the wing section extending to a position to make operable contact with and close the hopper doors.

3. The system of claim 1 wherein the motion control segment comprises:

a tubular cylindrical control section having an internal diameter incrementally greater than the external diameter of the tubular frame guide member, the tubular cylindrical control section movably positioned around the tubular frame guide member and connected to a first one of the plurality of coil springs of the linkage assembly;

a lateral motion connector attached to and extending radially out from the tubular cylindrical control section, the lateral motion connector linked to the linear actuator; and a rotational motion connector attached to and extending radially out from the tubular cylindrical control section, the rotational motion connector linked to the rotational actuator.

4. The system of claim 3 wherein the lateral motion connector comprises a ball in socket joint.

5. The system of claim 3 wherein the rotational motion connector comprises a toothed sprocket coaxially fixed on the tubular cylindrical control section and fitted with a sprocket chain.

6. The system of claim 3 wherein the linear actuator comprises a hydraulic cylinder having a piston shaft and extending between a point on the tubular frame guide member and the motion control segment.

7. The system of claim 6 wherein the lateral motion connector comprises a ball in socket joint, the ball of the joint positioned on the motion control segment and the socket of the joint positioned on the piston shaft of the hydraulic cylinder.

8. The system of claim 6 further comprising a hydraulic pump and controller connected to the hydraulic cylinder and operable to direct a translational motion to the plurality of closer arm wing segments, translational motion in a first direction operable to close a first plurality of hopper doors and translational motion in a second direction operable to close a second plurality of hopper doors.

9. The system of claim 3 wherein the rotational actuator comprises a hydraulic motor rotatably linked to the motion control segment.

10. The system of claim 9 wherein the rotational motion connector comprises a toothed sprocket coaxially fixed on the tubular cylindrical control section and fitted with a sprocket chain, the sprocket chain forming a continuous loop between the toothed sprocket and the hydraulic motor.

11. The system of claim 9 further comprising a hydraulic pump and controller connected to the hydraulic motor and operable to direct a rotational motion to the plurality of closer arm wing segments, rotational motion in a first direction operable to position the plurality of closer arm wing segments adjacent the hopper doors and rotational motion in a second direction operable to position the plurality of closer arm wing segments apart from the hopper doors.

* * * * *